US005890751A

United States Patent [19]

Seffinga

[11] Patent Number: 5,890,751

[45] Date of Patent: Apr. 6, 1999

[54] FLOOR MOUNTED DOOR LOCK

[76] Inventor: Allen L. Seffinga, 2603 300th St., Marshalltown, Iowa 50158

[21] Appl. No.: 994,928

[22] Filed: Dec. 19, 1997

[51] Int. Cl.[6] ..... F05C 5/00

[52] U.S. Cl. ..... 292/67; 16/82; 292/290; 292/DIG. 15; 292/342

[58] Field of Search ..... 292/67, 290, 298, 292/DIG. 15, 202, 203, 238, 289, 342; 16/82

[56] References Cited

U.S. PATENT DOCUMENTS

| | | | |
|---|---|---|---|
| 2,122,312 | 6/1938 | Cassion | 292/342 |
| 3,805,322 | 4/1974 | Serrano | 292/DIG. 15 |
| 4,114,936 | 9/1978 | Dominguez | 292/342 |
| 4,501,444 | 2/1985 | Dominguez | 292/342 |
| 4,552,395 | 11/1985 | Dominguez | 292/342 |
| 4,631,776 | 12/1986 | King | 292/DIG. 15 |
| 4,673,203 | 6/1987 | Chezem | 292/DIG. 15 |
| 4,797,970 | 1/1989 | Charlton | 292/DIG. 15 |
| 5,809,613 | 9/1998 | Baines | 292/DIG. 15 |

FOREIGN PATENT DOCUMENTS

| | | | |
|---|---|---|---|
| 2244311 | 11/1991 | United Kingdom | 292/DIG. 15 |

*Primary Examiner*—Suzanne Dino Barrett
*Assistant Examiner*—Stephen Grady
*Attorney, Agent, or Firm*—Zarley, McKee, Thomte, Voorhees & Sease

[57] ABSTRACT

A keyless floor mounted door lock of this invention has a horizontal rectangular frame with a rectangular opening therein having first and second sides and opposite ends. A first downwardly extending bar is secured to one of the sides of the frame and a second downwardly extending bar extends parallel thereto in spaced relation. A pivotal surface is located on the under side of the frame at the ends of the slot which is created by the space between the first and second bars. A stop plate has a size slightly smaller than the opening in the frame and is slidably mounted in the slot when in a vertical position, and has opposite sides and opposite ends. Hinge elements are located on one of the sides of the stop plate adjacent the ends, and have a tang element extending longitudinally from each end for engagement with a pivotal surface on the bottom face of the frame. The stop plate is held against pivotal movement with respect to the frame by the aforementioned bars when in a vertical position and when the stop plate has moved downwardly in the slot a distance sufficient for the tangs to move out of engagement with the pivotal surfaces.

3 Claims, 5 Drawing Sheets

FLOOR MOUNTED DOOR LOCK

BACKGROUND OF THE INVENTION

Hotel rooms and the like have latch locks to which the room occupants, hotel maids, and perhaps others have keys. Thus, with several keys being in the possession of several persons, the room is not entirely secure. Doors for other rooms in businesses and residences often pose the same problem.

It is therefore a principal object of this invention to have a keyless floor mounted door lock which can be operated only by the person within the room which is locked.

A further object of this invention is to have a keyless floor mounted lock which is easy to operate, and which is decorative in appearance when both in and out of use.

These and other objects will be apparent to those skilled in the art.

SUMMARY OF THE INVENTION

A keyless floor mounted door lock of this invention has a horizontal rectangular frame with a rectangular opening therein having first and second sides and opposite ends. A first downwardly extending bar is secured to one of the sides of the frame and a second downwardly extending bar extends parallel thereto in spaced relation. A pivotal surface is located on the under side of the frame at the ends of the slot which is created by the space between the first and second bars.

A stop plate has a size slightly smaller than the opening in the frame and is slidably mounted in the slot when in a vertical position, and has opposite sides and opposite ends. Hinge elements are located on one of the sides of the stop plate adjacent the ends, and have a tang element extending longitudinally from each end for engagement with a pivotal surface on the bottom face of the frame. The stop plate is held against pivotal movement with respect to the frame by the aforementioned bars when in a vertical position and when the stop plate has moved downwardly in the slot a distance sufficient for the tangs to move out of engagement with the pivotal surfaces.

An alternate form of the invention comprises a doorstop with an inclined stop surface, with opposite sides and upper and lower ends. Side members extend downwardly from the opposite sides of the stop surface and terminate in a horizontal lower edge. Cleat elements are located on the lower edge and are capable of rigidly engaging a carpet layer to rigidly hold the doorstop against longitudinal movement in a direction horizontally outwardly from the upper end of the stop surface.

DESCRIPTION OF THE PREFERRED EMBODIMENT

Figure 1:
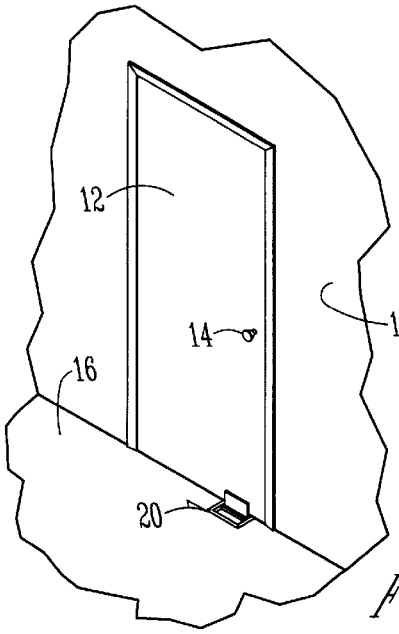
FIG. 1 is a partial perspective view of a wall and a door with the device of this invention in place.

With reference to FIG. 1, the numeral 10 designates a wall structure having a conventional door 12, knob 14 and floor surface 16. A carpet 18 is shown on a floor surface in FIG. 13.

Figure 2:
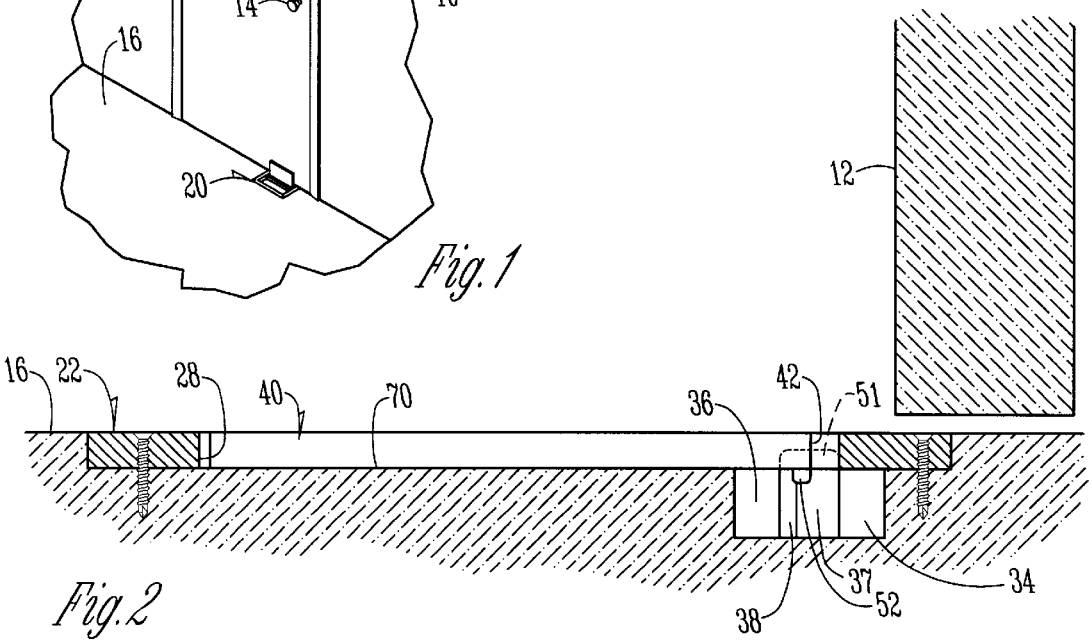
FIG. 2 is an enlarged scale partial sectional view of the device of this invention shown in its inoperative position.
Figure 5:
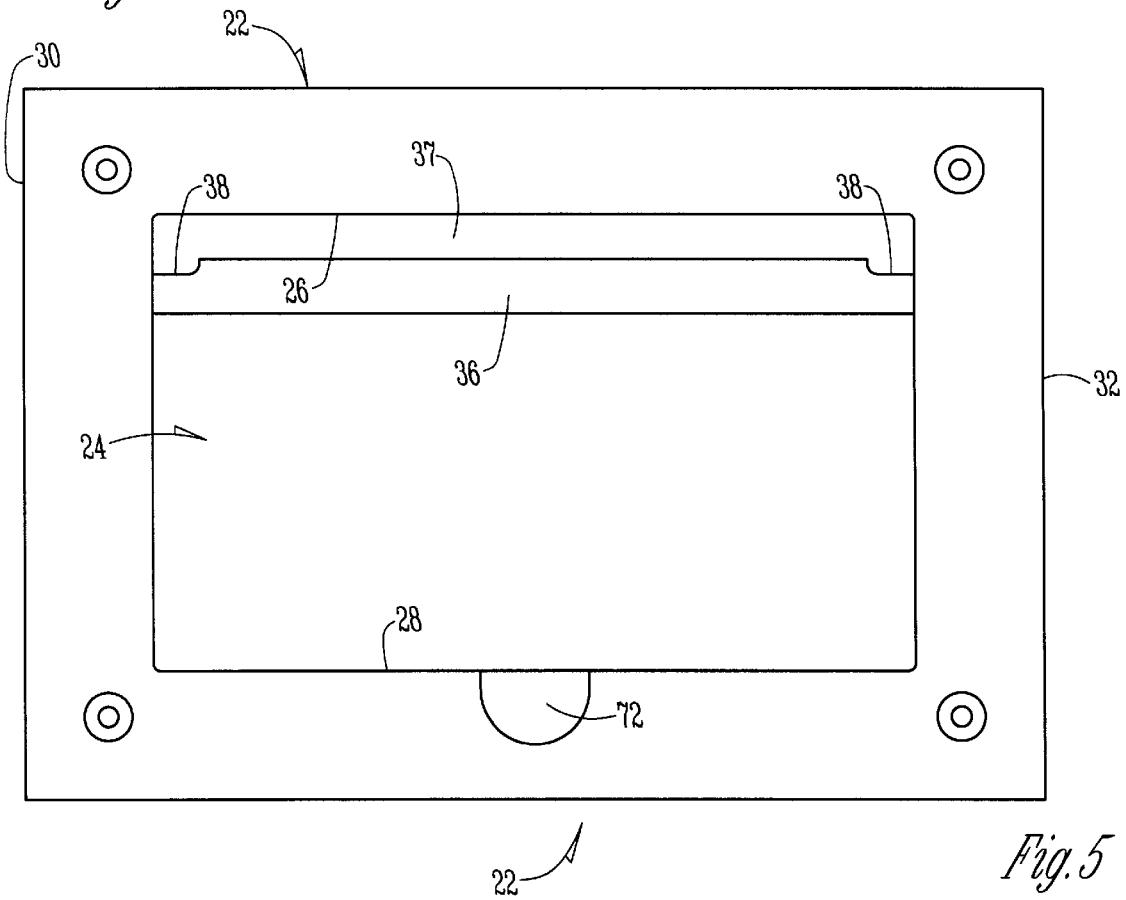
FIG. 5 is a top plan view of the frame.
Figure 6:
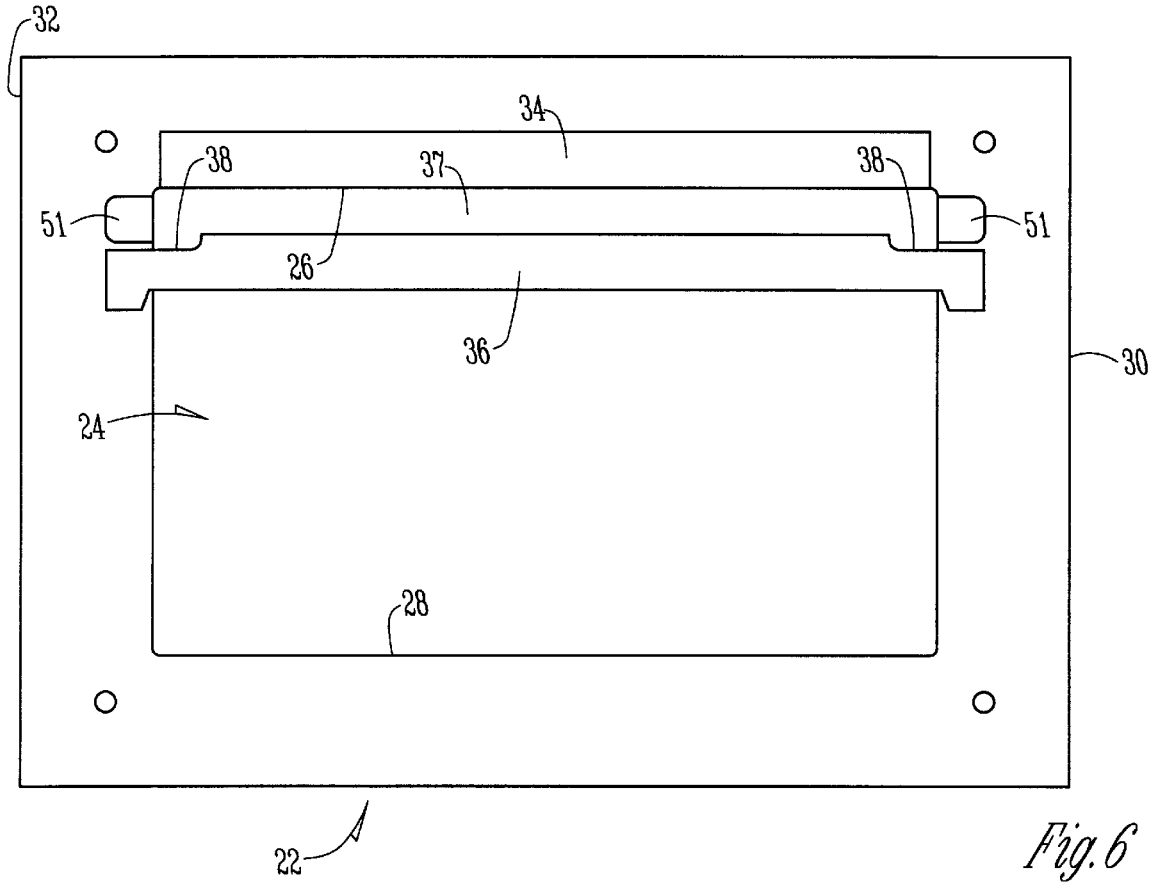
FIG. 6 is a bottom plan view of the frame.

The door lock 20 is comprised of a rectangular frame 22 which has a rectangular center opening 24. The center opening has sides 26 and 28, and ends 30 and 32 (FIG. 5). An elongated bar 34 (FIG. 6) extends along the bottom of frame 22 at side 26 of opening 24, and extends downwardly therefrom. (FIG. 2). A second bar 36 is also cast with frame 22 and is parallel to bar 34 in slight spaced relationship thereto to create space or slot 37 (FIGS. 5 and 6). A notch 38 appears adjacent each end of bar 36 and communicates with notch 37.

Figure 7:
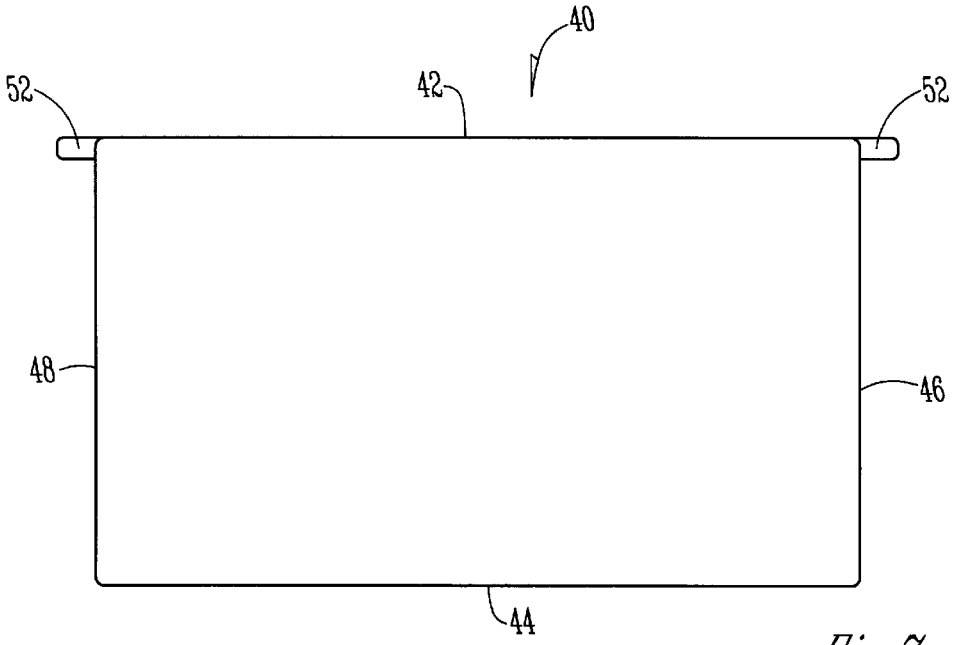
FIG. 7 is a top plan view of the stop plate.
Figure 8:
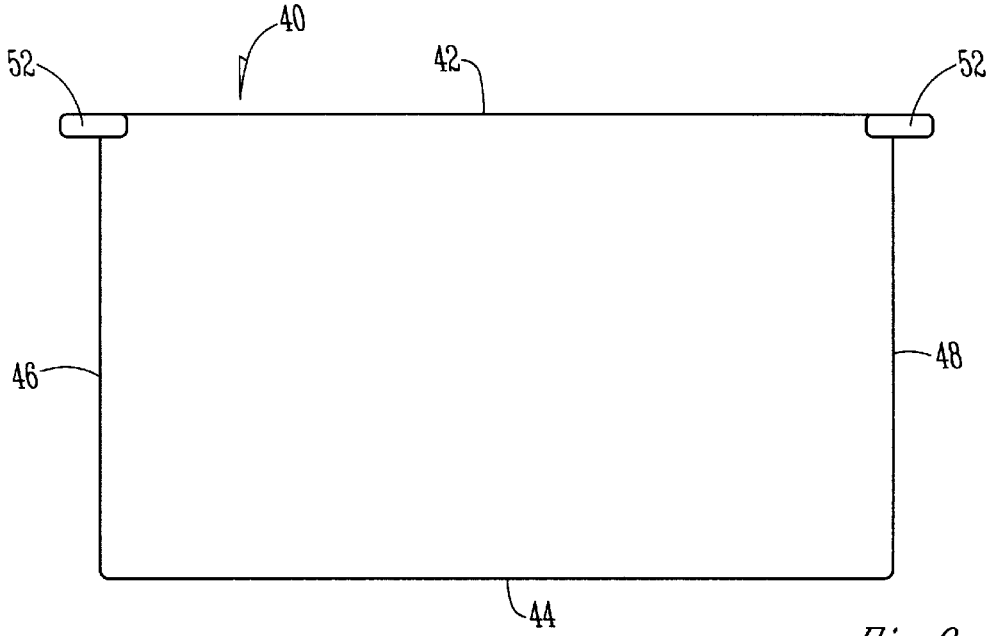
FIG. 8 is a bottom plan view of the stop plate.
Figure 9:
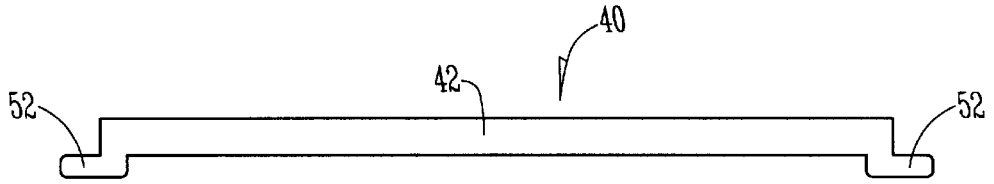
FIG. 9 is an elevational view of the stop plate as seen from the bottom of FIG. 7.
Figure 10:
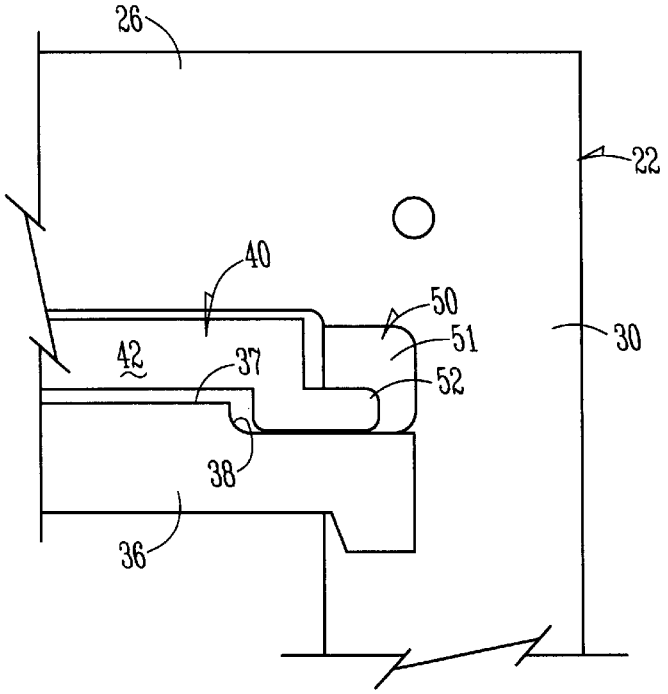
FIG. 10 is an enlarged scale partial plan view of the assembled device with the stop plate in a vertical position.

A lock plate 40 is best shown in FIGS. 7, 8 and 9 and has sides 42 and 44, and ends 46 and 48. A hinge element 50 extends downwardly and thence outwardly from the side 42 of plate 40 as best shown in FIGS. 7–9. The hinge elements 50 then terminate in a tang element 52 which extends outwardly beyond the opposite ends 46 and 48 of the plate 40.

Figure 12:
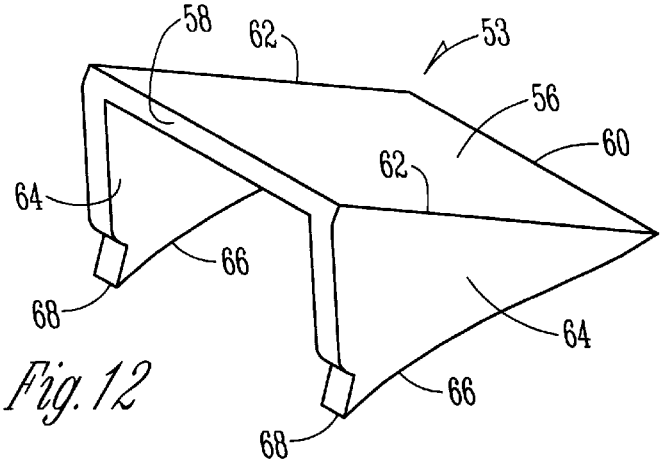
FIG. 12 is a perspective view of a modified form of the invention.
Figure 13:
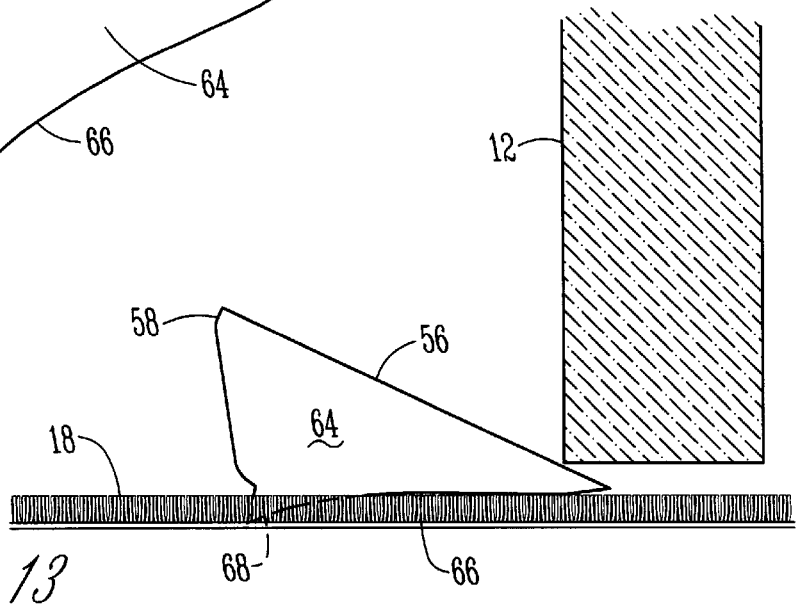
FIG. 13 is a side elevational view of the device in FIG. 12 shown at a reduced scale in its operative position.

An alternate floor mounted lock plate 54 is shown in FIGS. 12 and 13 and is comprised of a ramp or lock surface 56 with an upper end 58 and a lower end 60. Ramp 56 has side edges 62 with downwardly extending sidewalls 64. Each of the sidewalls 64 terminate at their lower portions in a horizontal bottom edge 66. A pointed cleat 68 is formed on the bottom edge 66 and is adapted to penetrate and rigidly grip carpet 18 (FIG. 13).

Figure 3:
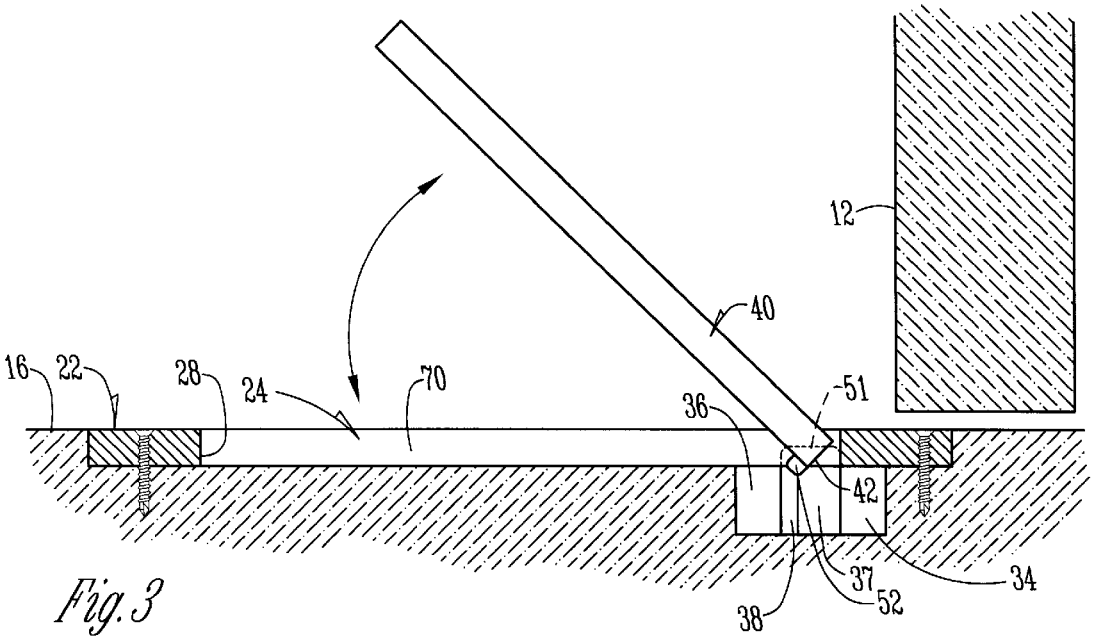
FIG. 3 is a view similar to FIG. 2 but shows the stop plate being Med in a pivotal relation to the frame.
Figure 4:
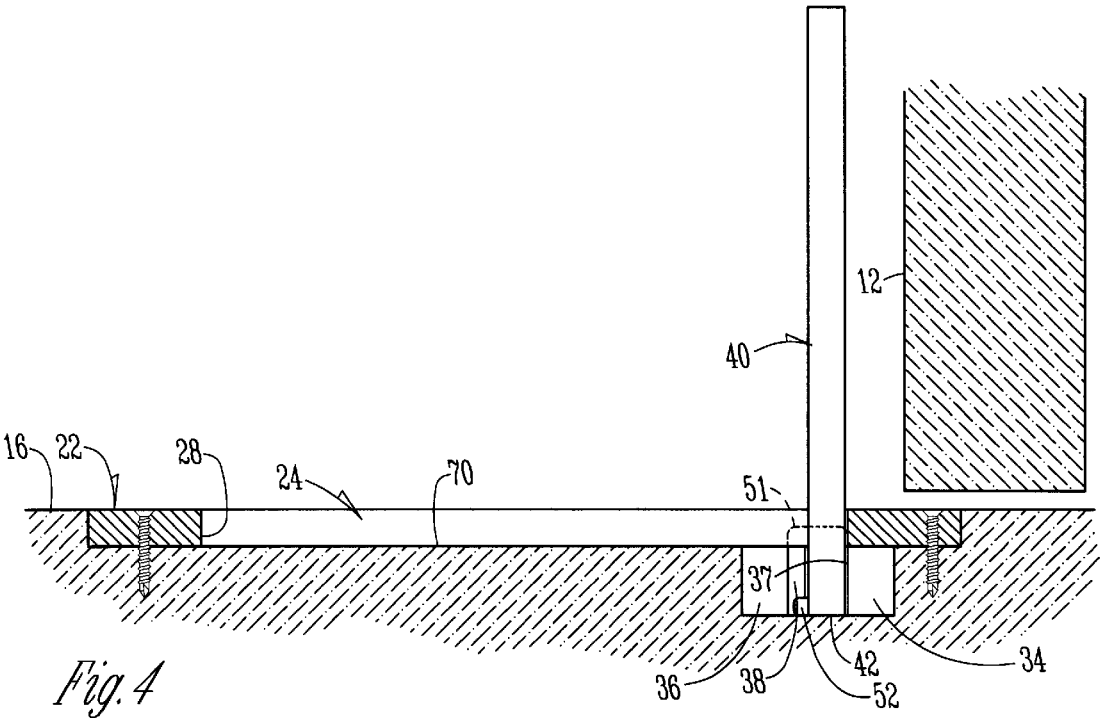
FIG. 4 is a view similar to that of FIG. 3 but shows the stop plate in its operative vertical position.
Figure 11:
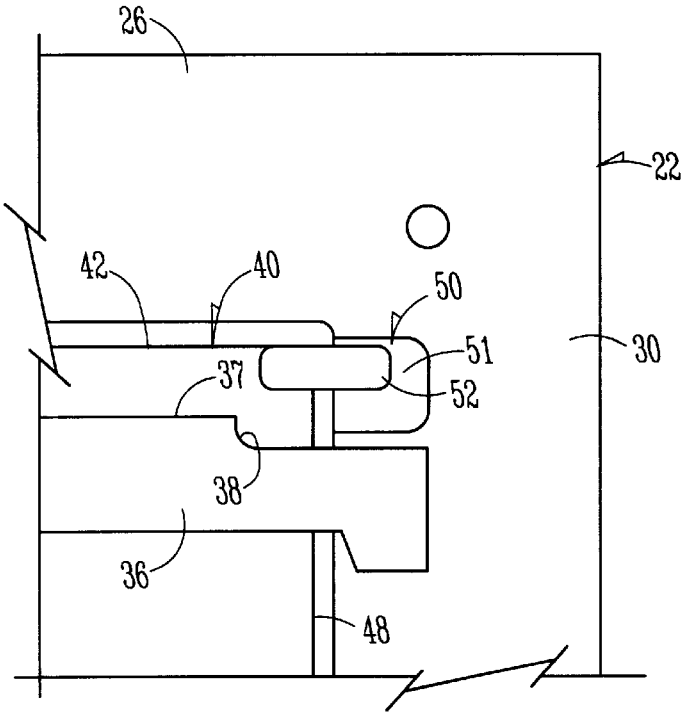
FIG. 11 is a bottom plan view similar to that of FIG. 10 but with the stop plate in a horizontal and operative position.

In operation, the frame 22 is located within a recess 70 in the floor surface 16 (FIGS. 2, 3 and 4). When in the operative position, the lock plate 40 is in the horizontal position of FIGS. 2 and 11 with the tangs resting within the hinge surfaces 51 as best shown in FIG. 11.

When it is desired to place the door lock 20 in its operating position as shown in FIG. 1, the recessed access groove 72 (FIG. 5) in frame 22 can be accessed by the finger of the operator to move the plate 40 from the position of FIG. 2 up through the position of FIG. 3 to the vertical position shown in FIG. 4. Upon being moved to the vertical position in FIG. 4, the plate 40 drops downwardly within slot 37 for it is no longer held in the upper position of FIGS. 2 and 3 by the bar 36. When in the position of FIG. 4, the plate 40 cannot pivot with respect to the frame 22 and is held in its vertical position in the slot 37 between the bars 34 and 36.

The recess 70 is located immediately adjacent the door 12 as shown in FIGS. 1 through 4 so that any movement of the door 14 into the room will cause the door to abut plate 40 and prevent its opening.

When it is desired to disengage the lock plate 40 from the vertical position of FIG. 4, it is merely lifted so that the tangs 52 on hinge elements 50 reengage hinge surface 51 whereupon the plate 40 will pivot downwardly from the its lifted position to the horizontal position as shown in FIG. 3.

Description Of Alternate Embodiment

The door lock 54 is positioned adjacent the door 12 as best shown in FIG. 3 with the lower edge 60 either engaging the door or penetrating any space underneath the door. The cleats 68 are embedded in the carpet 18 so as to prevent any movement of the door lock 54 in a direction away from the door. Thus, any movement of the door towards the door lock 50 will be resisted by the ramp or rock surface 56.

It is therefore seen that this invention will achieve all of its stated objectives.

What is claimed is:

1. A floor mounted door lock mechanism, comprising a horizontal rectangular frame with a rectangular opening therein having first and second sides and opposite ends a first downwardly extending bar secured along one of said sides, a second downwardly extending bar having opposite ends and secured to the ends of said frame to create a narrow elongated slot between said first and second bars, a pivotal surface on an underside of said frame at the ends of said slot, a stop plate having a size slightly smaller than said opening in said frame being slidably mounted in said slot when in a vertical position, and having opposite sides and opposite ends, hinge elements on one of the sides of said stop plate adjacent said ends, and having a tang element extending longitudinally therefrom for engagement with said pivotal surfaces, said stop plate being held against pivotal movement with respect to said frame by said bars when in a vertical position and when said stop plate has moved downwardly in said slot a distance sufficient for said tangs to move out of engagement with said pivotal surfaces.

2. The device of claim 1 wherein a depression is located in said frame opposite to first bar to permit said stop plate, when in a horizontal position, to be manually lifted and rotated upwardly on said hinge elements.

3. The device of claim 1 wherein said stop plate can be removed from said slot only in a downwardly direction to permit said tangs to clear the ends of said slot.

* * * * *